US005509450A

United States Patent [19]

Tholander

[11] Patent Number: 5,509,450

[45] Date of Patent: Apr. 23, 1996

[54] WEFT YARN FEEDING DEVICE HAVING A ROTATING RETAINER

[75] Inventor: Lars H. G. Tholander, Ulricehamn, Sweden

[73] Assignee: IRO AB, Ulricehamn, Sweden

[21] Appl. No.: 351,236

[22] PCT Filed: Jun. 11, 1993

[86] PCT No.: PCT/EP93/01485

§ 371 Date: Jan. 26, 1995

§ 102(e) Date: Jan. 26, 1995

[87] PCT Pub. No.: WO93/25742

PCT Pub. Date: Dec. 23, 1993

[30] Foreign Application Priority Data

Jun. 12, 1992 [DE] Germany ..... 42 19 306.0

[51] Int. Cl.[6] ..... D03D 47/36

[52] U.S. Cl. ..... 139/452

[58] Field of Search ..... 139/452; 242/47.01

[56] References Cited

U.S. PATENT DOCUMENTS

| | | | |
|---|---|---|---|
| 4,586,543 | 5/1986 | Volland et al. | 139/452 |
| 4,799,517 | 1/1989 | Bucher | 139/452 |
| 4,811,762 | 3/1989 | Bucher et al. | 139/452 |
| 4,832,270 | 5/1989 | Jacobsson | 242/47.01 |
| 5,154,209 | 10/1992 | Takegawa | 139/452 |

FOREIGN PATENT DOCUMENTS

| | | |
|---|---|---|
| 0080692 | 6/1983 | European Pat. Off. . |
| 0226930 | 7/1987 | European Pat. Off. . |
| 0243565 | 11/1987 | European Pat. Off. . |
| 0253760 | 1/1988 | European Pat. Off. . |
| 0477877 | 4/1992 | European Pat. Off. . |
| 60-28552 | 2/1985 | Japan . |
| 2255986 | 11/1992 | United Kingdom . |

*Primary Examiner*—Andy Falik

*Attorney, Agent, or Firm*—Flynn, Thiel, Boutell & Tanis

[57] ABSTRACT

A device for feeding weft yarns to a weaving machine which includes a rotatingly driven retainer that is constructed such that it has little mass. The retainer is coupled to a rotary drive unit such that the retainer cannot move radially with respect to a storage drum axis so that, when viewed in the direction of circulation of the withdrawal point, the retainer continuously extends through a circulatory path ahead of the weft yarn. The rotary drive unit is additionally connected to a control device which controls the acceleration and deceleration of the retainer in accord with a speed profile and determines the process of weft insertion in the weaving machine.

11 Claims, 3 Drawing Sheets

WEFT YARN FEEDING DEVICE HAVING A ROTATING RETAINER

FIELD OF THE INVENTION

The present invention refers to a method for feeding weft yarns to a weaving machine where each weft yarn is unwound from a storage drum of a prewinder such that the weft yarn is positively fed by a rotatingly driven retainer which is driven in accordance with a circulatory speed profile. In the device for carrying out said method, the retainer travelling ahead of the weft yarn during unwinding and being controlled according to the speed profile.

BACKGROUND OF THE INVENTION

In accordance with a method known from EP-B1-0 253 760, a radially adjustable retainer, which is adapted to be driven in the circumferential direction of the stationary storage drum, is used for exactly dimensioning the length of the weft yarn and for decelerating the weft yarn at the end of the weft insertion process. During a weft insertion process, the retainer, which stands still in an engaged condition at a predetermined circumferential position of the storage drum, is disengaged so that, when the weft yarn is withdrawn, the withdrawal point will circulate at a rapidly increasing speed. In the course of the weft insertion process, the disengaged retainer is accelerated in the direction of circulation to a speed corresponding approximately to the speed at which the withdrawal point circulates. The withdrawal point will, however, first pass below the disengaged retainer. Then the retainer is engaged. The weft yarn moves into contact with the retainer at the withdrawal point, whereupon it will be decelerated by the engaged retainer until it is standing still at a new predetermined circumferential position. The retainer, which is included in a traveller together with an actuating magnet, has a comparatively big mass, and this will cause problems during acceleration and deceleration. It is difficult to activate the actuating magnet at the correct moment in the course of the rotary movement of the retainer. In view of the big mass which has to be decelerated, it is difficult to bring the engaged retainer to a standstill so that the deceleration process will be comparatively long. This will have a negative influence on the process of weft insertion in the weaving machine, since the deceleration phase lasts comparatively long.

A method known from JP 85-077 054 (60-28 552) comprises the steps of rotating the radially adjustable retainer in the circumferential direction of the storage drum as soon as said retainer has been disengaged so as to exactly dimension the length of the weft yarn. At the new position, the retainer is reengaged after the last admissible passage of the withdrawal point so that the weft yarn will reliably be caught. During the weft insertion process, the retainer does not influence the weft yarn withdrawal movement. At the end of the weft insertion process, the weft yarn is stopped abruptly. The storage drum is stationary.

In accordance with a method known from EP-A1-0 80 692, the storage drum as well as the retainer are rotatingly driven. The retainer is additionally adapted to be moved between an engaged position at which it blocks the circulatory path of the withdrawal point and a disengaged position.

In accordance with a method known from EP-A1-02 26 930 and used for feeding a yarn to a flat knitting machine, a changeover is effected between a positive feeding operation and free feeding of the yarn. A stationary storage drum has associated therewith a rotatable yarn guiding member, which is adapted to be driven such that it carries out a rotational movement about the storage drum axis and which is constructed in such a way that the withdrawal point of the yarn can overtake the yarn guiding member under certain pre-conditions (free feeding), whereas in the positive feeding mode the circumferential speed of the yarn guiding member determines the quantity of yarn fed per unit time.

In accordance with a method known from EP-A-0 477 877, the weft yarn, which is measured by a measuring prewinder by means of a radially adjustable retainer, is fed by an independently driven positive feed mechanism of the picking device, said positive feed mechanism being arranged subsequent to the storage drum. The positive feed operation is, however, discontinued during the weft insertion process so that the picking device continues to feed the weft yarn until it is standing still.

It is the object of the present invention to provide a method as well as a device of the type mentioned at the beginning by means of which the process of weft insertion can, on the one hand, be optimized as far as the weaving machine is concerned and, on the other hand, be carried out as gently as possible as far as the weft yarn is concerned; the present invention even aims at achieving a process of weft insertion which is adapted to be modulated from one weft insertion to the next. For jet weaving machines, it is the object of the present invention to make the weft yarn length exactly dimensionable, and in the case of shuttleless weaving machines, projectile or gripper weaving machines it is the object of the present invention to adapt the process of weft yarn withdrawal to an optimized weft insertion process.

SUMMARY OF THE INVENTION

The above object is achieved by a method which includes the steps of positively feeding a weft yarn during a weft insertion process in a weaving machine by a rotatingly driven retainer which is continuously active ahead of a withdrawal point, and accelerating and decelerating the retainer in accord with a speed profile, which determines the process of the weft insertion.

In the device which effects this method, the retainer has a relatively small mass and travels ahead of the weft yarn through a circulatory path. A rotary drive unit of the retainer is operatively connected to a control device so as to control the speed profile of the retainer while supervising the angular position thereof and thereby determining the process of the weft insertion in the weaving machine.

BRIEF DESCRIPTION OF THE DRAWINGS

Embodiments of the subject matter of the invention are explained on the basis of the drawings, in which.

DETAILED DESCRIPTION

Figure 1:
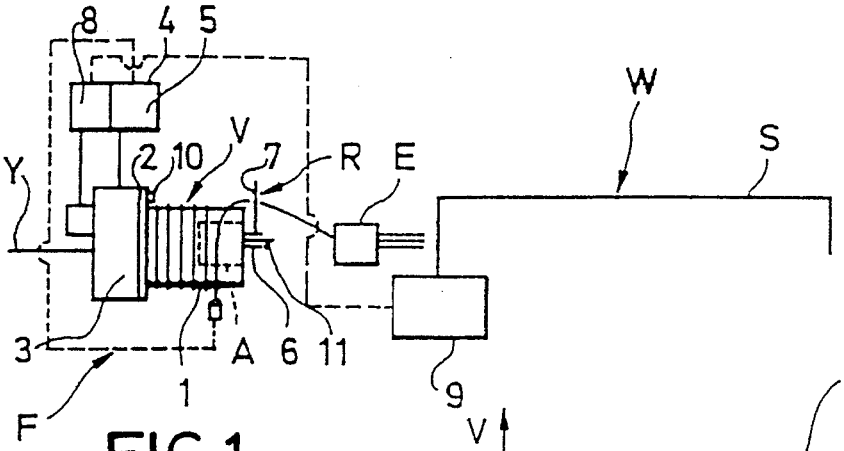
FIG. 1 shows a schematic representation of a device for feeding weft threads to a weaving machine.

According to FIG. 1, a prewinder F, which is used for feeding a weft yarn Y, is provided on one side of a weaving machine W. The prewinder F unwinds the weft yarn Y from a supply coil, which is not shown, and winds it tangentially in windings onto the circumference of a storage drum 1 as part of a weft yarn supply V by means of a winding mechanism 2 including a winding element 10. A weft insertion device E of the weaving machine W unwinds the weft yarn overhead from the weft yarn supply V on the storage drum and inserts it into the weaving shed S. The weft insertion device E is either a main nozzle (air-jet weaving machine) having associated therewith auxiliary nozzles, which are not shown, within the shed, or e.g. a gripper of a gripper weaving machine.

In the embodiment according to FIG. 1, the storage drum 1 of the prewinder is standing still. The winding mechanism 2 is driven with the aid of a drive means 3 and by means of a control device 4 via a control device element 5 in such a way that a specific thread supply size is always maintained. On the withdrawal side, the weft yarn Y is positively fed during each weft insertion process. For this purpose, a retainer R in the form of a radial pointer 7 is provided, said radial pointer 7 being arranged on a drive shaft 6, which is coaxial with the storage drum axis 11, and extending continuously through the circulatory path U of the point where the weft yarn Y is withdrawn over the front edge of the storage drum 1 (cf. FIG. 2). A separate rotary drive means A (indicated by a broken line in the interior of the storage drum 1) is provided for said retainer R, said rotary drive means A controlling a specific speed profile of the pointer 7 via a control device 8.

Figure 2:
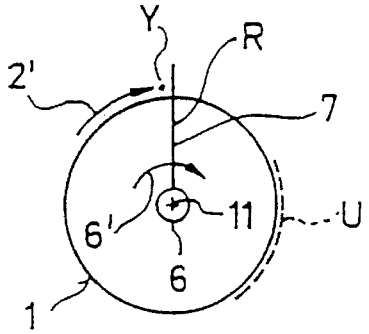
FIG. 2 shows a front view of part of the device according to FIG. 1.

According to FIG. 2, the winding mechanism 2 winds the weft yarn onto the storage drum 1 in the direction of an arrow 2'. During unwinding, the point where the weft yarn Y is withdrawn circulates along a circulatory path U in the direction of the arrow 2'. The retainer R is positioned ahead of the withdrawal point when seen in the direction of circulation 2'. During the weft insertion process, the retainer R is accelerated in the direction of an arrow 6' from a first angular position at which it is standing still and, at the end of the weft insertion process, it is decelerated until it reaches a second predetermined angular position at which it is standing still.

Figure 3:
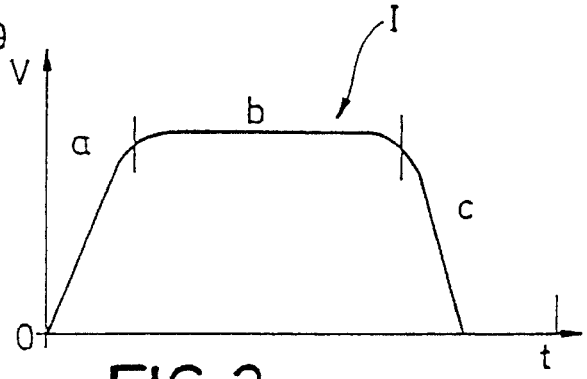
FIG. 3 shows a diagram of a first expedient speed profile.

FIG. 3 clearly shows a speed profile I which determines the unwinding operation. The vertical axis represents the unwinding speed v; the horizontal axis represents the time Z. The speed profile I is characterized by an accelerating section a, a high-speed section b and a subsequent decelerating section c. The retainer R is driven in the direction of the arrow 6' precisely in accordance with the speed profile I according to FIG. 3 so that the weft yarn Y will be positively fed and inserted by the weft insertion device E. The speed profile I belongs e.g. to an air-jet weaving machine.

FIG. 3 clearly shows the speed profile I of a shuttleless gripper weaving machine in which the weft yarn is transferred approximately at the center of the shed S. The speed profile I according to FIG. 4 is characterized by a first acceleration phase a1, a subsequent high-speed phase b1, which is followed by a first deceleration phase c1, a second acceleration phase a2, a subsequent second high-speed phase b2 and a final deceleration phase c2.

Figure 4:
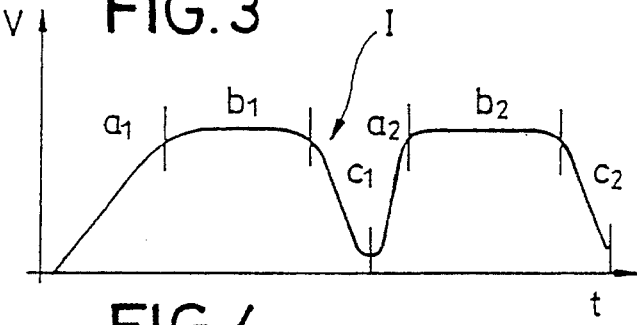
FIG. 4 shows a diagram of a second expedient speed profile.

The retainer R is in this case driven in accordance with the speed profile I of FIG. 4 so that the weft yarn will be positively fed during the whole weft insertion process.

Being constructed as a pointer 7, the retainer R has little mass and, consequently, it can be decelerated and accelerated with a small-size, fast-responding electric motor. The electric motor is either provided with an angle-of-rotation decoder, which is not shown and which transmits the respective angular position of the pointer 7 in relation to the circumference of the storage drum 1 to the control device 8, or it is constructed as a stepping motor whose respective angular position is known to the control device anyhow.

Figure 5:
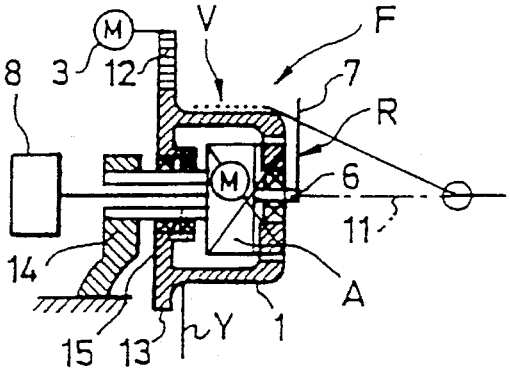
FIG. 5 shows a schematic longitudinal section of an alternative embodiment of such a device.
Figure 6:
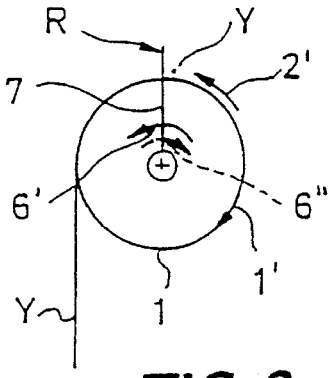
FIG. 6 shows a front view of the device according to FIG. 5.

In the embodiment according to FIG. 5 and 6, the storage drum 1 of the prewinder F is adapted to be driven such that it rotates about its axis 11. For example, a circumferential flange 13 is constructed as a support for a driving belt 12 which is connected to the drive means 3. The weft yarn Y is supplied tangentially without any deflection and is incorporated in the thread supply V. The storage drum 1 is rotatably supported on a supporting tube 15 of a stationary holding means 14. In the interior of the storage drum 1, the supporting tube 15 has arranged thereon the rotary drive means A for the retainer R (pointer 7) in such a way that the drive shaft 6 projects beyond the front end of the storage drum 1 and carries the pointer 7. The control device 8, which includes a programmable microprocessor in accordance with an expedient embodiment, is connected to the rotary drive means A by the supporting tube 15.

According to FIG. 6, the storage drum 1 rotates in the direction of an arrow 1'. During the weft insertion process, the withdrawal point of the weft yarn Y migrates (anticlockwise) in the direction of arrow 2' along the front edge of the storage drum 1. The storage drum 1 simultaneously acts as the winding device for replenishing the thread supply V. Between the weft insertion processes, the pointer 7 rotates synchronoulsy with the storage drum 1. During the weft insertion process, the pointer 7 is first accelerated anticlockwise in the direction of arrow 6' to a speed exceeding the circumferential speed of the storage drum 1, and towards the end of the weft insertion process it is decelerated or reversed in the direction of arrow 6" until, after the weft insertion process, it will again rotate at the same circumferential speed and in the same direction as the storage drum 1.

Figure 7:
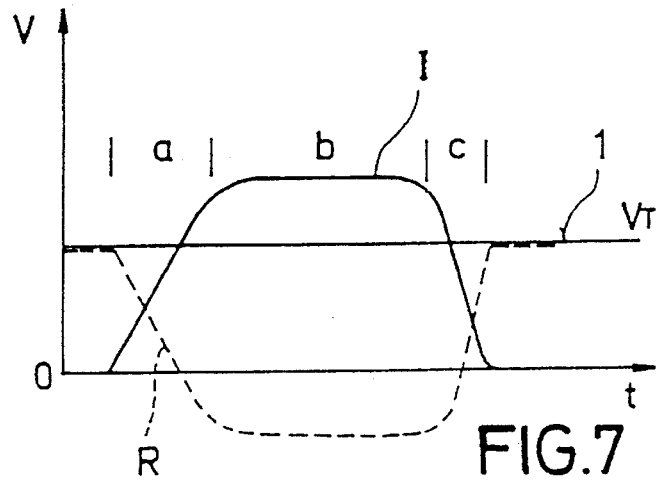
FIG. 7 shows a diagram of a speed profile of an embodiment according to FIGS. 5 and 6.

FIG. 7 clearly shows how the prewinder F according to FIG. 5 operates when used for an air-jet weaving machine. The speed profile I corresponds to the speed profile I of FIG. 3 and is representative of the speed of the weft yarn during the weft insertion process. The speed profile again comprises the acceleration phase a, the subsequent high-speed phase b and the final deceleration phase c. The horizontal line 1 represents a constant speed of the storage drum 1 which has been assumed to exist for the sake of simplicity. Until the weft insertion process starts, the retainer R rotates at this speed. When the weft insertion process starts, the retainer R is accelerated in a direction opposite to the direction of rotation of the storage drum 1; during the high-speed phase b, it rotates at a comparatively constant speed, whereupon it is decelerated or reversed relative to the storage drum 1 until it will reach again the speed of said storage drum 1.

For the sake of simplicity, the speed of the storage drum 1 is shown as a constant speed. It is, however, also possible to vary the speed of said storage drum 1. The control device 4, which is responsible for the rotation of the storage drum 1 and of the retainer R, will then control the desired speed profile I which is composed of the two relative speeds.

Figure 8:
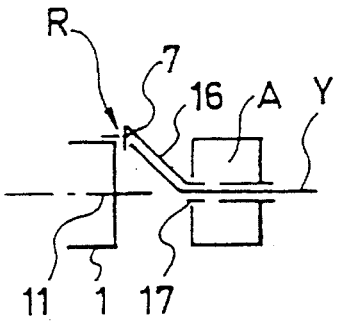
FIG. 8 shows a first variation of a detail in a longitudinal section.

In the embodiment according to FIG. 8, the retainer R is a pointer 7 which projects radially inwards and which is attached to an oblique arm 16 arranged on a hollow drive shaft 17, said hollow drive shaft 17 being supported e.g. in the rotary drive means A in front of and in spaced relationship with the front end of the storage drum 1 and defining a draw-off eyelet for the weft yarn Y.

Figure 9:
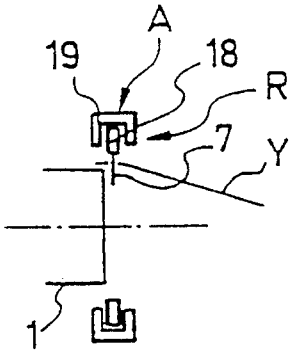
FIG. 9 shows a second variation of a detail in a longitudinal section.

In the embodiment according to FIG. 9, the retainer R is secured to an annular traveller 18 and defines a pointer which projects radially inwards, said traveller 18 surrounding the front end of the storage drum 1 and being supported in a driving support 19 of the rotary drive means A. The rotary drive means A is arranged externally of the storage drum 1 in this case.

Figure 10:
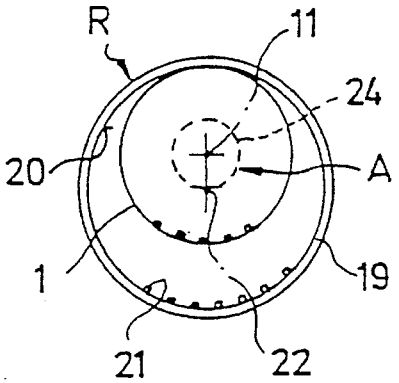
FIG. 10 shows a front view of an additional variation of a detail.

In the embodiment according to FIG. 10, the retainer R is a ring 19, which is arranged at right angles to the storage drum axis 11 at the front end of the storage drum 1, said ring 19 having an interior circumference 20 which is larger than the outer diameter of the storage drum 1. The center 22 of the ring 19 is arranged eccentrically with respect to the storage drum axis 11, said center 22 being rotatably supported on a crank drive A, 24 which is indicated by a broken line. The crank drive 24 rotates about the storage drum axis 11, a point of contact between the interior circumference 20 and the storage drum 1 circulating ahead of the withdrawal point when seen in the direction of circulation of the withdrawal point of the weft yarn Y. If desired, the interior circumference 20 is equipped with circumferential teeth 21 cooperating with complementary recesses on the storage drum 1.

Figure 11:
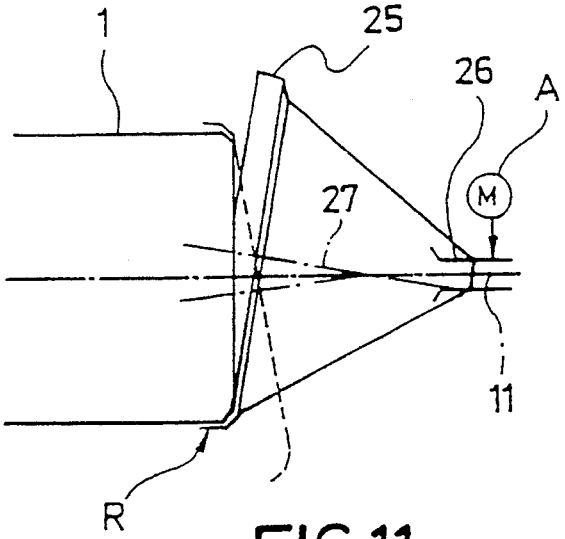
FIG. 11 shows a longitudinal section of an additional variation of a detail.

In the embodiment according to FIG. 11, the retainer R is a ring 25 whose interior diameter is larger than the outer diameter of the storage drum 1. The ring 25 is arranged at an inclined position such that its axis of adjustment 27 intersects the storage drum axis 11 at an oblique angle and it is secured to a hollow drive shaft 26 which is acted upon by the rotary drive means A. When the drive shaft 26 rotates, the ring 25 will carry out a wobbling movement with a circulating point of contact with the front edge of the storage drum 1.

Figure 12:
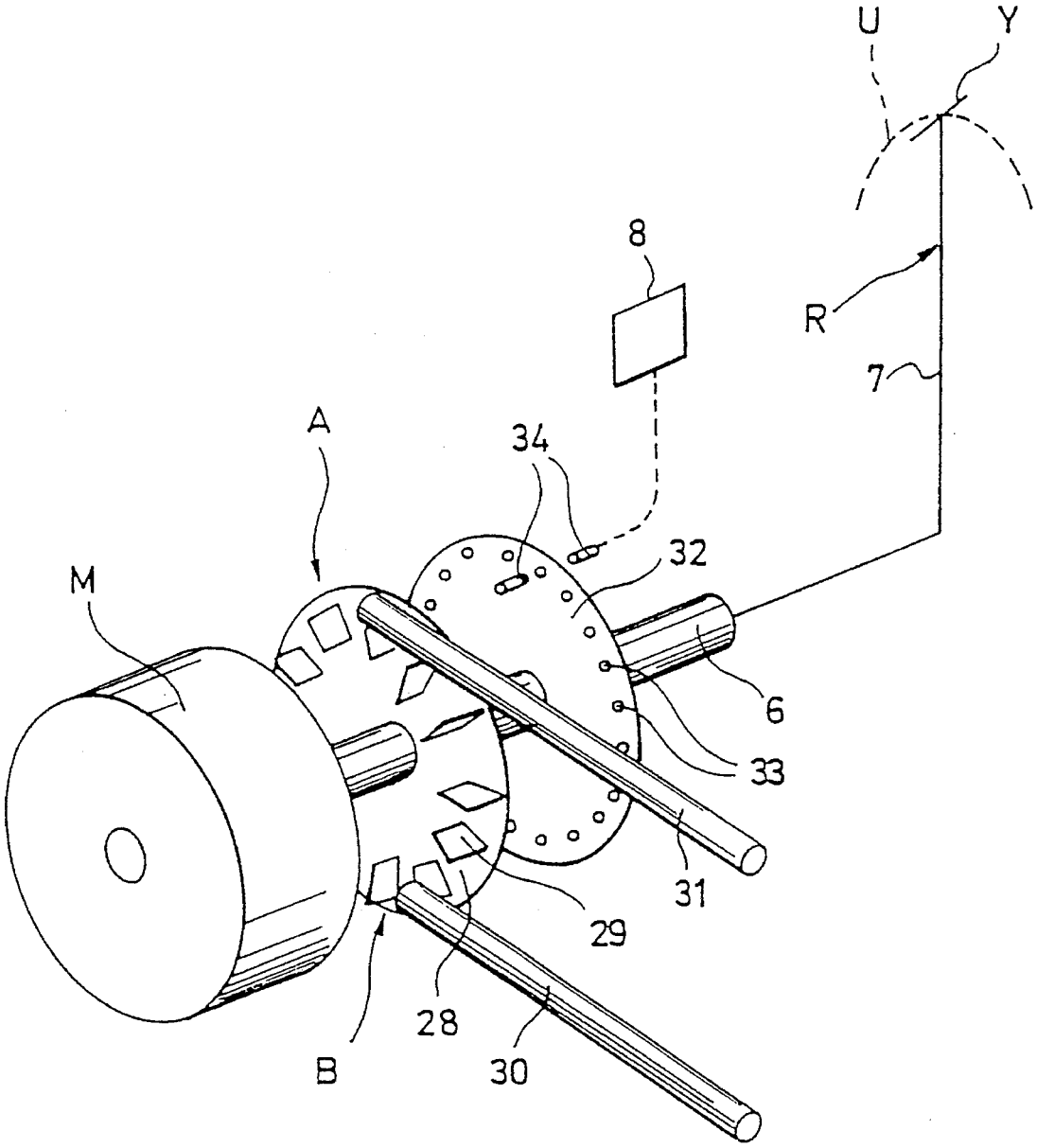
FIG. 12 shows a schematic perspective view of an additional variation.

FIG. 12 shows an embodiment of the rotary drive means A for the retainer R constructed as a pointer 7. The electric motor M drives the drive shaft 6. The drive shaft 6 has associated therewith a booster B which is temporarily activated, preferably for the acceleration and/or deceleration phases a, c, a1, a2, c1, c2, so as to support the electric motor M. In the embodiment shown, the booster B is provided with a turbine wheel 28 on said drive shaft 6. The turbine wheel 28 carries turbine blades 29, compressed-air nozzles 30, 31 being directed at said turbine blades 29. In cases in which the electric motor is not a stepping motor M, the drive shaft 6 has additionally secured thereto a disc 32 carrying angle-of-rotation transmitters 33; angle-of-rotation sensors 34 are in alignment with said angle-of-rotation transmitters 33 and transmit the signals to the control device 8 so that said control device 8 will continuously be informed of the angular position of the pointer 7.

The booster may just as well be driven mechanically via a flywheel, electromagnetically or by an eddy current. The important point is that, in spite of the influence exerted by the booster during the acceleration or deceleration phase, the control device cannot lose control of the rotary position of the pointer 7 even if, due to the effect produced by the booster, an acceleration or deceleration characteristic for the drive shaft occurs which the electric motor itself cannot produce.

More particularly, in the preferred method, the weft yarn is not left to its own devices at any time during the weft insertion process, but it is continuously fed in a positive feeding mode. Due to the positive feeding mode, the weft yarn has to follow a speed profile which is of such a nature that the weft yarn will be treated gently and which is adapted to the best possible weft insertion for the weaving machine in question. This will prevent detrimental changes in the weft yarn tension. Abrupt and critical accelerations as well as sudden decelerations will be avoided. In view of the fact that the speed profile is predetermined, the drive means of the weft insertion device can be adjusted precisely to the positive feeding process, and this will save driving power, e.g. compressed air, since the driving power surplus which has hitherto been necessary is now no longer required. In jet weaving machines the necessary weft yarn length is precisely dimensioned by means of the supervised angular position of the retainer. In shuttleless weaving machines, the speed profile is precisely adapted to the operating behavior of the weaving machine especially during the transfer phase so that detrimental changes in the tension of the weft yarn will be avoided. An advantageous thread geometry in the area of withdrawal and in the weaving shed will be obtained in any case (controlled thread balloon and optimized straightening).

A point of essential importance with regard to said method as well as with regard to the device is that the retainer and its rotary drive means have as little mass as possible so that the retainer can be accelerated and decelerated within a sufficiently short period of time.

The retainer can be constructed such that it has little mass due to the fact that it extends into the circulatory path continuously and that, consequently, an additional actuator for a radial displacement can be dispensed with. The supervision of the angular position of the retainer in relation to the storage drum is important, on the one hand, for exactly controlling the desired speed profile and, on the other hand, for precisely dimensioning the weft yarn length, if this should be necessary. The positive feed is carried out in an advantageous manner without any feed roller gap, which would apply a mechanical load to the weft yarn, since the contact with the retainer only produces a negligible effect.

In the embodiment where the storage drum is stationary and the retainer moves relative to the storage drum, the rotary drive means of the retarding element is responsible for the desired speed profile during the weft insertion process.

An alternative advantageous embodiment is where the storage drum is rotatingly driven and simultaneously constitutes the winding mechanism. This offers the advantage of particularly favorable feed conditions for the weft yarn which is fed to the weft yarn supply on the storage drum, since the weft yarn can be fed in a straight, tangential feeding mode which will not excessively stress the yarn and which will reduce malfunctions on the feed side to a minimum. This embodiment will also improve the withdrawal conditions (ballooning) because the rotating storage drum will deliver the weft yarn with less resistance, since the weft yarn supply rotates. The speed profile determining the process of weft insertion is derived from the speed conditions existing between the rotational movement of the storage drum and the rotational movement of the retainer. In this connection, it is advantageous that the retarding element need no longer be accelerated as quickly as before relative to the storage drum because the weft yarn supply already has a certain basic speed which can be utilized for the weft insertion process. In this embodiment, the weft yarn feed as well as the weft yarn withdrawal conditions are advantageous with respect to minor deflections, hardly noticeable changes in the yarn tension and a stabilized withdrawal of the yarn.

Another expedient embodiment is where the storage drum is stationary and a unidirectional rotary drive means suffices to achieve the desired speed profile. In this connection, it will be expedient to use a drive motor which has high acceleration and deceleration capacities and which, due to the retainer having little mass, can be sufficiently small but still adapted to be operated in a powerful and low-loss mode of operation. When the storage drum is adapted to be rotated, it will be expedient to provide a rotary drive means whose direction of rotation can be reversed so that also the deceleration phase can be controlled exactly. In some cases, a drive motor which can be decelerated rapidly and which is combined with a driving device will suffice.

In another expedient embodiment, the retainer is constructed as an approximately radial pointer which rotates coaxially about a storage drum axis. The pointer has extremely little mass. It can be accelerated and decelerated rapidly. The weft yarn cannot overtake the pointer. The speed of the weft yarn is precisely controlled by the pointer.

In addition a structurally simple, compact structural design results where the drive shaft of the pointer projects beyond the storage drum end from which the yarn is withdrawn, and the rotary drive unit for the pointer is disposed within the storage drum interior. This driving principle of the pointer can be used for a stationary as well as for a rotatable storage drum.

In an additional advantageous embodiment, the pointer extends radially inwards from an arm that is spaced from a front end of the storage drum and is attached to the hollow drive, and extends at an oblique angle towards the storage drum. In addition, the hollow drive shaft is coaxial with the storage drum axis and permits passage of the weft yarn therethrough. In the case of this structural design, the weft yarn withdrawn runs through the hollow drive shaft of the arm. This embodiment is particularly suitable for a stationary storage drum, the weft yarn being supplied centrally through the drive shaft to said stationary storage drum before it is incorporated into the yarn supply by the winding mechanism.

When the embodiment is used where the rotary drive means or unit is a stepping motor or an electric motor that has a relatively small mass and includes an angle-of-rotation decoder, the necessary accelerations and decelerations are easily achieved. As a result, the angle-of-rotation decoder or the stepping motor permit the control device to permanently determine the exact angular position of the retainer with respect to the circumference of the storage drum and to take this angular position into account during the control operation.

An important embodiment is also an acceleration and/or deceleration booster incorporated in the rotary drive means. The acceleration phase, which is used for accelerating the weft yarn to the maximum insertion speed within the shortest possible period of time, is particularly important with respect to the desired speed profile. In spite of the fact that the retainer is constructed such that it has little mass and in spite of the rapidly responding rotary drive means, even modern electric motors may reach or exceed their power limit in this respect, and, taking into account the high weft insertion frequencies which are nowadays realized, this may be problematic. The booster supports the rotary drive means in the acceleration phase and/or in the equally important deceleration phase. In this connection, it is, however, important that the control device will not lose control of the movement of the retainer and that the booster is, at most, used for compensating or eliminating mechanical inertia effects.

This is achieved in a structurally simple manner where the booster acts directly on the retainer or rather on the drive shaft thereof and helps the rotary drive means to cause the necessary acceleration and/or deceleration.

A structurally simple and functionally reliable embodiment having little mass is also provided where the booster includes the turbine wheel attached to the drive shaft and has a compressed-air nozzle directed thereagainst. The turbine wheel is acted upon by at least one compressed-air nozzle for accelerating and/or decelerating the retainer. The turbine wheel is adapted to be decoupled from the pointer, if desired, by a free-wheel clutch.

Another important embodiment is the embodiment wherein an angle-of-rotation transmitter is arranged on a retainer drive shaft or a disc thereof and a sensor connected to the control device is in alignment with the transmitter. Thus, in spite of the booster, the control device is continuously informed of the exact angular position of the retainer. The booster only acts as an aid which, so to speak, supplies additional driving power (for the deceleration and/or acceleration) to the drive motor without actively interfering with the control operation. This has the advantage that a small-size drive motor which has little mass and which will, consequently, respond rapidly can be used; without the use of such a booster, said drive motor would have to be much larger and would have to have a much more detrimental mass for achieving the desired acceleration and/or deceleration behavior.

An additional, expedient embodiment is disclosed wherein, especially when the storage drum is standing still, the signals from and to the drive motor as well as the operating voltage are transmitted by contact-less transmission. This can, however, also be advantageous when a rotatable storage drum is used.

The embodiment having at least one programmable microprocessor in the control device is advantageous because the desired speed profile can precisely be controlled, varied, modulated and repeated by the programmable microprocessor. The control device can have supplied thereto information from the weaving machine and/or from the control device of the prewinder so that the individual parameters can exactly be adapted to one another. If necessary, the speed profile, or only the positively fed thread length, are changed from one weft insertion process to the next.

In the embodiment wherein the pointer is arranged in a traveller which is driven from outside, the traveller coaxially surrounds the storage drum and is supported on a rotary drive means disposed radially outside of the storage drum. Especially in cases in which a stationary storage drum is used, this will simplify the mechanical structural design of the device.

In a still further embodiment, positive feeding of the weft thread is carried out by the ring. The point of contact between the ring and the circumference of the storage drum circulates ahead of the withdrawal point. A minor eccentricity suffices to produce the desired effect. The ring has balloon-reducing properties. The mechanical structural design is simple and reliable.

Finally, the embodiment also is expedient wherein the retainer is defined by an interior circumference of the ring which is in contact with the storage drum outer circumference and has a diameter greater than the outer circumference. The ring has an axis of adjustment which intersects the storage drum axis at an oblique angle. In said embodiment, the ring fulfills a balloon-limiting function and defines the retainer when carrying out its wobbling movement.

A point of essential importance with respect to the present invention is, especially as far as air-jet weaving machines are concerned, the permanent positive feeding in combination with weft thread length measuring and overhead unwinding.

Although particular preferred embodiments of the invention have been disclosed in detail for illustrative purposes, it will be recognized that variations or modifications of the disclosed apparatus, including the rearrangement of parts, lie within the scope of the present invention.

I claim:

1. A device for feeding weft yarns to a weaving machine provided with a weft insertion device, said device comprising a prewinder which includes a storage drum for storing a weft yarn supply, a winding mechanism for replenishing the weft yarn supply, and a controlled retainer which is adapted to be driven in the circumferential direction of the storage drum by a rotary drive means such that the retainer carries out a circulatory movement, said controlled retainer extending at least temporarily through a circulatory path of a withdrawal point of the weft yarn which is adapted to be unwound overhead from the storage drum by means of said weft insertion device, wherein the retainer is a generally radially extending pointer which is adapted to be rotated coaxially about a storage drum axis and has little mass, and when viewed in the direction of circulation of the withdrawal point, the retainer continuously extends through the circulatory path ahead of the weft yarn, the rotary drive means of the retainer being connected to a control device with which a circulatory speed profile of the retainer is controlled while supervising the angular position of the retainer, said circulatory speed profile determining the process of weft insertion in the weaving machine.

2. A device according to claim 1, wherein the pointer is arranged on a drive shaft which is coaxial with the storage drum axis, the drive shaft of said pointer projecting beyond the storage drum end located on a withdrawal side, the storage drum having a hollow interior and the rotary drive means being arranged in the interior of the storage drum.

3. A device according to claim 1, wherein the pointer is arranged such that it extends radially inwards from an arm which is attached to a hollow drive shaft adapted to be driven by said rotary drive means and which extends at an oblique angle outwards towards the storage drum, said hollow drive shaft being coaxial with the storage drum axis, and said arm being arranged in a spaced relationship with a front end of the storage drum together with said hollow drive shaft and together with said rotary drive means, said hollow drive shaft being constructed such that the weft yarn can pass therethrough.

4. A device according to claim 1, wherein the pointer projects approximately radially inwards from a traveller which extends around an exterior of the storage drum and which is coaxial with said storage drum, said traveller being supported by the rotary drive means which is arranged radially outside of the storage drum.

5. A device for feeding weft yarns to a weaving machine provided with a weft insertion device, said device comprising a prewinder which includes a storage drum for storing a weft yarn supply, a winding mechanism for replenishing the weft yarn supply, and a controlled retainer which is adapted to be driven in the circumferential direction of the storage drum by a rotary drive means such that the retainer carries out a circulatory movement, said controlled retainer extending at least temporarily through a circulatory path of a withdrawal point of the weft yarn which is adapted to be unwound overhead from the storage drum by means of said weft insertion device, wherein when viewed in the direction of circulation of the withdrawal point, the retainer continuously extends through the circulatory path ahead of the weft yarn and has little mass, the rotary drive means of the retainer including an acceleration and/or deceleration booster and being connected to a control device with which a circulatory speed profile of the retainer is controlled while supervising the angular position of the retainer, said circulatory speed profile determining the process of weft insertion in the weaving machine.

6. A device according to claim 5, wherein the booster is adapted to a drive a drive shaft of the retainer.

7. A device according to claim 5, wherein the booster includes a turbine wheel attached to a drive shaft of the retainer, at least one compressed-air nozzle being directed at said turbine wheel.

8. A device for feeding weft yarns to a weaving machine provided with a weft insertion device, said device comprising a prewinder which includes a storage drum for storing a weft yarn supply, a winding mechanism for replenishing the weft yarn supply, and a controlled retainer having a drive shaft which is adapted to be driven in the circumferential direction of the storage drum by a rotary drive means such that the retainer carries out a circulatory movement, said controlled retainer extending at least temporarily through a circulatory path of a withdrawal point of the weft yarn which is adapted to be unwound overhead from the storage drum by means of said weft insertion device, wherein when viewed in the direction of circulation of the withdrawal point, the retainer continuously extends through the circulatory path ahead of the weft yarn and has little mass, the rotary drive means of the retainer being connected to a control device with which a circulatory speed profile of the retainer is controlled while supervising the angular position of the retainer, said circulatory speed profile determining the process of weft insertion in the weaving machine, angle-of-rotation transmitters being arranged on the drive shaft of the retainer and at least one angle-of-rotation sensor connected to the control device and disposed adjacent the drive shaft so to be positioned for alignment with varying ones of the angle-of-rotation transmitters during rotation of the drive shaft.

9. A device according to claim 8, wherein the angle-of-rotation transmitters are arranged on a disc disposed on the drive shaft.

10. A device for feeding weft yarns to a weaving machine provided with a weft insertion device, said device comprising a prewinder which includes a storage drum for storing a weft yarn supply, a winding mechanism for replenishing the weft yarn supply, and a controlled retainer which is adapted to be driven in the circumferential direction of the storage drum by a rotary drive means such that the retainer carries out a circulatory movement, said controlled retainer extending at least temporarily through a circulatory path of a withdrawal point of the weft yarn which is adapted to be unwound overhead from the storage drum by means of said weft insertion device, wherein when viewed in the direction of circulation of the withdrawal point, the retainer continuously extends through the circulatory path ahead of the weft yarn and has little mass, the rotary drive means of the retainer including an electric motor and being connected to a control device with which a circulatory speed profile of the retainer is controlled while supervising the angular position of the retainer, said circulatory speed profile determining the process of weft insertion in the weaving machine, a contactless signal and operating-voltage transmission path being provided between the electric motor and the control device.

11. A device for feeding weft yarns to a weaving machine provided with a weft insertion device, said device comprising a prewinder which includes a storage drum for storing a weft yarn supply, a winding mechanism for replenishing the weft yarn supply, and a controlled retainer which is adapted to be driven in the circumferential direction of the storage drum by a rotary drive means such that the retainer carries out a circulatory movement, said controlled retainer extending at least temporarily through a circulatory path of a withdrawal point of the weft yarn which is adapted to be unwound overhead from the storage drum by means of said weft insertion device, wherein when viewed in the direction of circulation of the withdrawal point, the retainer continuously extends through the circulatory path ahead of the weft yarn and has little mass, the rotary drive means of the retainer being connected to a control device with which a circulatory speed profile of the retainer is controlled while supervising the angular position of the retainer, said control device including at least one programmable microprocessor, and said circulatory speed profile determining the process of weft insertion in the weaving machine.

* * * * *